US006658877B2

(12) United States Patent
Kjøng-Rasmussen

(10) Patent No.: US 6,658,877 B2
(45) Date of Patent: Dec. 9, 2003

(54) VALVE ARRANGEMENT WITH EXPANSION VALVE

(75) Inventor: Lars Bo Kjøng-Rasmussen, Sønderborg (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 10/154,593

(22) Filed: May 23, 2002

(65) Prior Publication Data

US 2002/0174670 A1 Nov. 28, 2002

(30) Foreign Application Priority Data

May 26, 2001 (DE) ..... 101 25 789

(51) Int. Cl.[7] ..... F25B 41/04; G05D 23/00
(52) U.S. Cl. ..... 62/222; 236/92 B
(58) Field of Search ..... 236/92 B, 80 R; 62/222

(56) References Cited

U.S. PATENT DOCUMENTS 6,053,417 A 4/2000 Hotta et al. ..... 236/92 B
6,244,561 B1 * 6/2001 Hansen, III ..... 251/30.02

FOREIGN PATENT DOCUMENTS

DE 27 49 252 B2 1/1980 ..... F03G/7/06
EP 0230396 * 7/1987 ..... 236/80 R

OTHER PUBLICATIONS

"Sporlan Bulletin 30–10", Jan. 1993, pp. 17 and 18. "Automatic Controls for Refrigeration Plant and Air Conditioning Systems", Danfoss Catalogue 1996/97, 7 pgs.

* cited by examiner

*Primary Examiner*—William Wayner
(74) *Attorney, Agent, or Firm*—McCormick, Paulding & Huber LLP

(57) ABSTRACT

In a valve arrangement for closing off a working line in a refrigeration system, the working line includes a high and a low-pressure section. An expansion valve is coupled to the working line and has a working pressure chamber forming part of the valve. A control line system that includes a control device is coupled to the expansion valve and defines a connection that is in full communication with the high and low pressure sections of the working line. A closure element forming part of the control device is positioned in the connection line and arranged in the pressure equalizing configuration that couples the working pressure chamber of the expansion valve to the low-pressure section of the working line.

11 Claims, 5 Drawing Sheets

VALVE ARRANGEMENT WITH EXPANSION VALVE

CROSS-REFERENCE TO RELATED APPLICATIONS

This application is entitled to the benefit of and incorporates by reference essential subject matter disclosed in German Patent Application No. 101 25 789.9 filed on May 26, 2001.

FIELD OF THE INVENTION

The invention relates to a valve arrangement for shutting off a working line in a refrigeration system with an expansion valve, which is arranged in the working line, and a control line system connecting the expansion valve with a low-pressure side and a high-pressure side of the working line, the expansion valve being controllable by the control line system, and the control line system being able to provide a closing pressure in the expansion valve by means of a control device.

BACKGROUND OF THE INVENTION

An arrangement of this kind is known from "Sporlan Bulletin 30-10" of January 1993, pages 17 and 18 wherein a valve arrangement is shown, in which the working line of a refrigeration circuit can be closed by means of a solenoid valve. The actual closing and opening of the working line takes place via the expansion valve, which is controlled by the solenoid valve. The solenoid valve is a 3-way valve, which has a connection line for the expansion valve, as well as a high-pressure connection and a pressure-equalising connection for the working line. During normal operation of the expansion valve, the connection line is connected with the pressure-equalising line via the solenoid valve. In order to close the expansion valve, the connection between the connection line and the pressure-equalising connection is closed via the solenoid valve, and at the same time a connection is created between the connection line and the high-pressure connection. The high pressure, which now is controlling in the expansion valve, ensures that the expansion valve closes the working line.

U.S. Pat. No. 6,053,417 shows a valve arrangement with a solenoid valve working directly in the working line within the expansion valve. When closing the solenoid valve, a high pressure propagates inside the expansion valve and ensures that a valve element, which is also arranged in the working line, comes to rest against a valve seat. This arrangement of both valves in the working line should reduce the disturbing noises when opening and closing the expansion valve. When, however, this is to be used with large refrigeration systems, the solenoid valve must also be large, which causes an increase in the cost of such refrigeration systems.

Thus, the prior art arrangements have either employ small, relatively expensive control devices, which are arranged outside the working line, or relatively large control devices, which work within the working line. In both cases, the manufacturing cost is high for the valve arrangement.

Based on the foregoing it is the general object of the present invention to improve upon or overcome the problem and drawbacks associated with the prior art.

SUMMARY OF THE INVENTION

The invention is based on the task of simplifying the closing of a working line in a refrigeration system.

According to the invention, this task is accomplished by means of a valve arrangement, in which the control device has a closure element in a connection path, via which the control line system connects a high-pressure side with a low-pressure side and the closing pressure can build up in the expansion valve.

In this way, it is possible to build up the closing pressure for the expansion valve by shutting off the connection path in the control line system. The size of the closing element merely has to be adapted to the connection path, which can be relatively small compared with the working line. "Working line" here means the line, in which the actual flow of a refrigerant in the refrigeration system occurs. On the other hand, the control line system comprises lines like those of the connection path, which merely ensure a gradual pressure equalising or propagation of control pressures.

It is favourable that the closing element is arranged in a pressure-equalising connection, which connects a working pressure chamber of the expansion valve with the low-pressure side. With such an arrangement, a high pressure, which acts upon the working pressure chamber of the expansion valve from the high pressure side via the control line system, is removed again via the pressure-equalising connection. In the closed state of the closing element, however, the high pressure builds up before the closing element and acts back upon the working pressure chamber. Thus, in a simple way, the high pressure available in the refrigeration system can be utilised for closing the expansion valve. In this way, a fast and reliable closing of the expansion valve can be ensured.

It is advantageous that the smallest cross-section of the pressure-equalising connection is larger than that of a high-pressure control line, which connects the working pressure chamber with the high-pressure side. Thus, it is achieved that the high pressure, which acts upon the connection path from the high-pressure side, is removed again via the pressure-equalising connection in the open state of the closing element, and cannot build up in the working pressure chamber at all. In this way, an unwanted closing of the expansion valve can be prevented. In this case, the expansion valve works as an expansion valve without a high-pressure control line. The pressure-equalising connection, the high-pressure control line and the working pressure chamber form the connection path.

Further, it is advantageous that the relationship between the smallest cross-section of the high-pressure control line and the smallest cross-section of the pressure-equalising line is approximately 1:20. In the open state of the closing element, this means that the pressure in the high-pressure control line is removed reliably via the pressure-equalising line. In this way, a high operation reliability of the arrangement can be achieved.

Further, it is favourable that the area of the pressure-equalising connection acted upon by the closing element is arranged outside a valve housing of the expansion valve. With this method, it is possible also to use commercially available expansion valves. Such valves can be modified or expanded in a simple way, which reduces the costs.

In a further embodiment, the area of the pressure-equalising connection, upon which the closing element acts, is arranged inside the valve housing of the expansion valve. In this way, a relatively compact design of the valve arrangement can be achieved.

Further, it is advantageous that the closing element is made on the valve housing of the expansion valve. In this way, an optimum matching between the control device and its closing element can be achieved during manufacture of the expansion valve. Thus, the mode of operation of the valve arrangement can be optimised. Further, this ensures a compact design of the expansion valve and the closing element.

It is also favourable that the high-pressure control line is arranged outside the valve housing of the expansion valve. Such a high-pressure control line can also be fitted on a commercially available expansion valve in a simple manner. Thus, the manufacturing cost of the valve arrangement can be further reduced.

In an alternative embodiment, the high-pressure control line is arranged inside the valve housing of the expansion valve.

Further, it is favourable that the high-pressure control line is formed by a predetermined leakage path in the expansion valve. Such predetermined leakage paths are very easily made in a traditional expansion valve, for example, by removing seals. Thus, separate bores for creating the high-pressure control line can be avoided. The leakage paths can, for example, be in the shape of bores, in which movable parts of the expansion valve are guided and which connect the working line with the working pressure chamber.

It is also advantageous that the connection path through the closing element can be hermetically closed. The term "hermetical" means that with the conditions occurring during normal operation, an at least substantially tight closing of the connection path is achieved. In this way, it is possible to build up a particularly high closing pressure for the expansion valve. Further, the closing pressure is available relatively fast.

Further, it is favourable that the closing element is in the form of a solenoid valve. Thus, it is possible to select a proven control device, which ensures a reliable operation of the valve arrangement.

BRIEF DESCRIPTION OF THE DRAWINGS

In the following, the invention is described in detail on the basis of a preferred embodiment in connection with the drawings, showing.

DETAILED DESCRIPTION OF THE PREFERRED EMBODIMENTS

Figure 1:
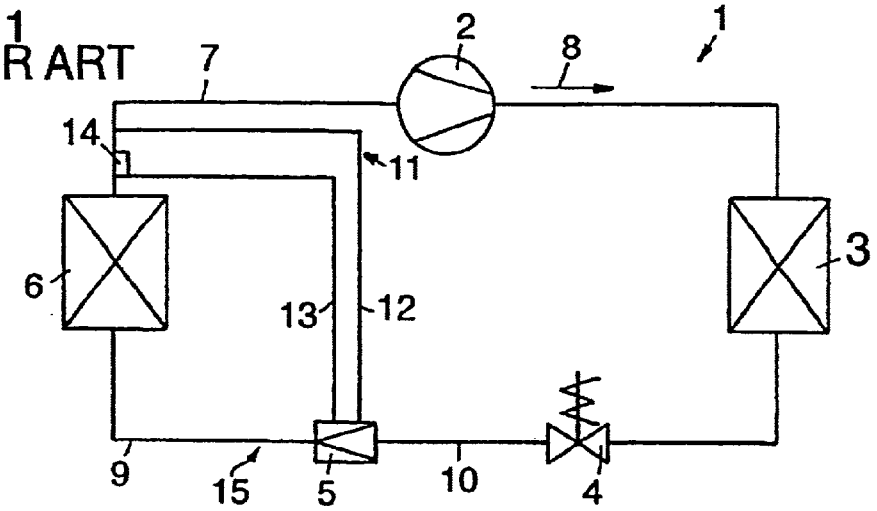
FIG. 1 PRIOR ART
FIG. 1 schematically illustrates a refrigeration system with a known valve arrangement FIG. 2 schematically illustrates a refrigeration system with a valve arrangement according to the invention FIG. 3 schematically illustrates a refrigeration system with a further embodiment of the valve arrangement according to the invention

FIG. 1 shows a traditional refrigeration system 1, in which a compressor 2, a condenser 3, a closing element 4, an expansion valve 5 and an evaporator 6 are arranged in series in a circuit via a working line 7. The closing element is in the form of a solenoid valve. In a flow direction, indicated by the arrow labelled 8, of a refrigerant of the refrigeration system 1, a low-pressure side 9 of the working line 7 is connected downstream, between the expansion valve 5 and the compressor 2, and a high-pressure side 10 of the working line 7 is connected upstream of the expansion valve 5.

Further, the refrigeration system 1 has a control line system 11 with a pressure-equalizing connection 12, which connects the expansion valve 5 with the low-pressure side of the working line 7. Further, the refrigeration system 1 has a thermal connection 13, which connects a bulb 14, which is arranged in an area of the low-pressure side 9 on the working line 7 downstream of the evaporator 6, with the expansion valve 5. The expansion valve 5, the closing element 4, the control line system 11 as well as the thermal connection 13 and the bulb 14 form a valve arrangement 15.

The operation of such a refrigeration system 1 is commonly known. The refrigerant of the refrigeration system 1 leaves the compressor 2 as a gas under high pressure and is subsequently condensed under heat emission in the condenser 3. Subsequently, the liquid refrigerant passes the solenoid valve 4 and reaches the expansion valve 5. Here, the refrigerant is expanded and passed on to the evaporator as a mixture of gas and fluid, which now has a relatively low pressure. In the evaporator 6, the refrigerant is evaporated under heat absorption and returns to the condenser 2 as superheated gas.

During normal operation, such a refrigeration system 1 is turned on as soon as an area to be cooled exceeds a predetermined turn-on temperature. The refrigeration system 1 stays on, until the temperature in the refrigerated area drops below a predetermined turn-off value. Then, the refrigeration system 1 is turned off and stays off until the temperature once again exceeds the predetermined turn-on temperature.

With the solenoid valve 4 liquid refrigerant is prevented from being trapped in the compressor 2 or between the compressor 2 and the evaporator 6 when the refrigeration system 1 is turned on. Otherwise, the compressor 2 would attempt to compress the liquid refrigerant, which could cause damage to the compressor. For this reason, the solenoid valve 4 of the valve arrangement 15 is located directly in the working line 7, and must be relatively large, which in turn causes relatively high costs on the refrigeration system 1.

Figure 2:
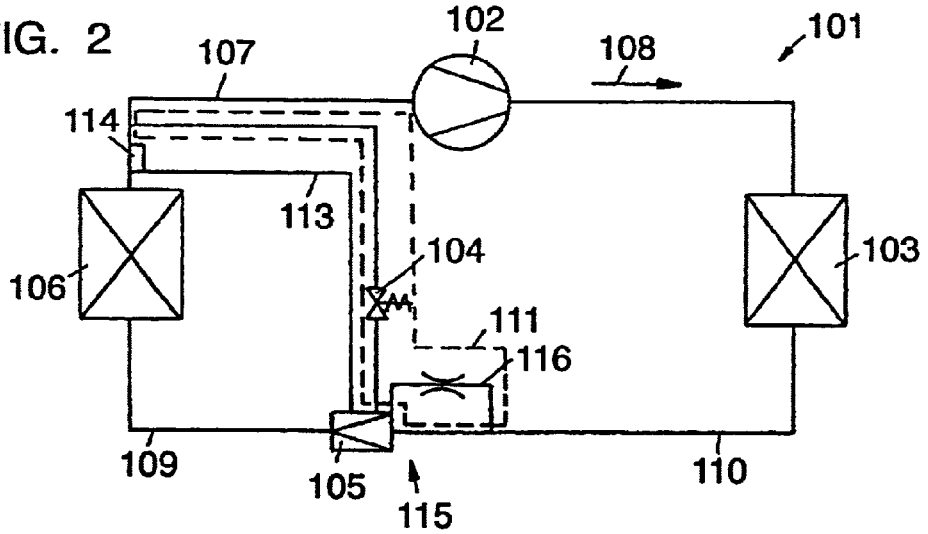

FIG. 2 shows the refrigeration system 101 with an embodiment of the valve arrangement 115 in accordance with the present invention. The refrigeration system shown in FIG. 2 is somewhat similar to that of FIG. 1 with like elements bearing the same reference numbers preceded by the number 1.

The closing element 104 is arranged in the pressure-equalizing connection 112 of the control line system 111 (dashed lines). The control line system 111 has a high-pressure control line 116, which extends from the expansion valve 105 to the high-pressure side 110.

Figure 3:
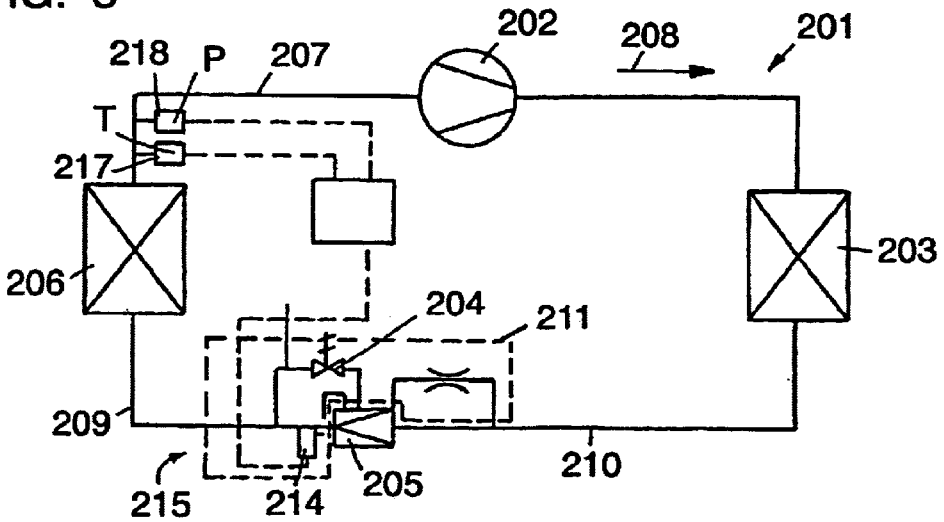

FIG. 3 shows the refrigeration system with a further embodiment of the valve arrangement 215. The refrigeration system 201 shown in FIG. 3 is somewhat similar to the refrigeration system shown in FIGS. 1 and 2. Accordingly, like elements will be indicated by like reference numbers preceded by the number 2. In this embodiment, the closing element 204 is arranged in a pressure-equalizing connection 212, which connects the expansion valve 205 with an area of the low-pressure side 209, which is arranged between the expansion valve 205 and the evaporator 206.

Further, this embodiment comprises a bulb 214 arranged between the expansion valve 205 and the evaporator 206 on the working line 207. The bulb 214 is provided with a heating element, which is controlled by a control unit RE. The control of the heating occurs via data, which is obtained from a temperature sensor 217 and a pressure sensor 218. The temperature sensor 217 and the pressure sensor 218 arranged at the outlet of the evaporator 206 on the working line 207.

Figure 4:
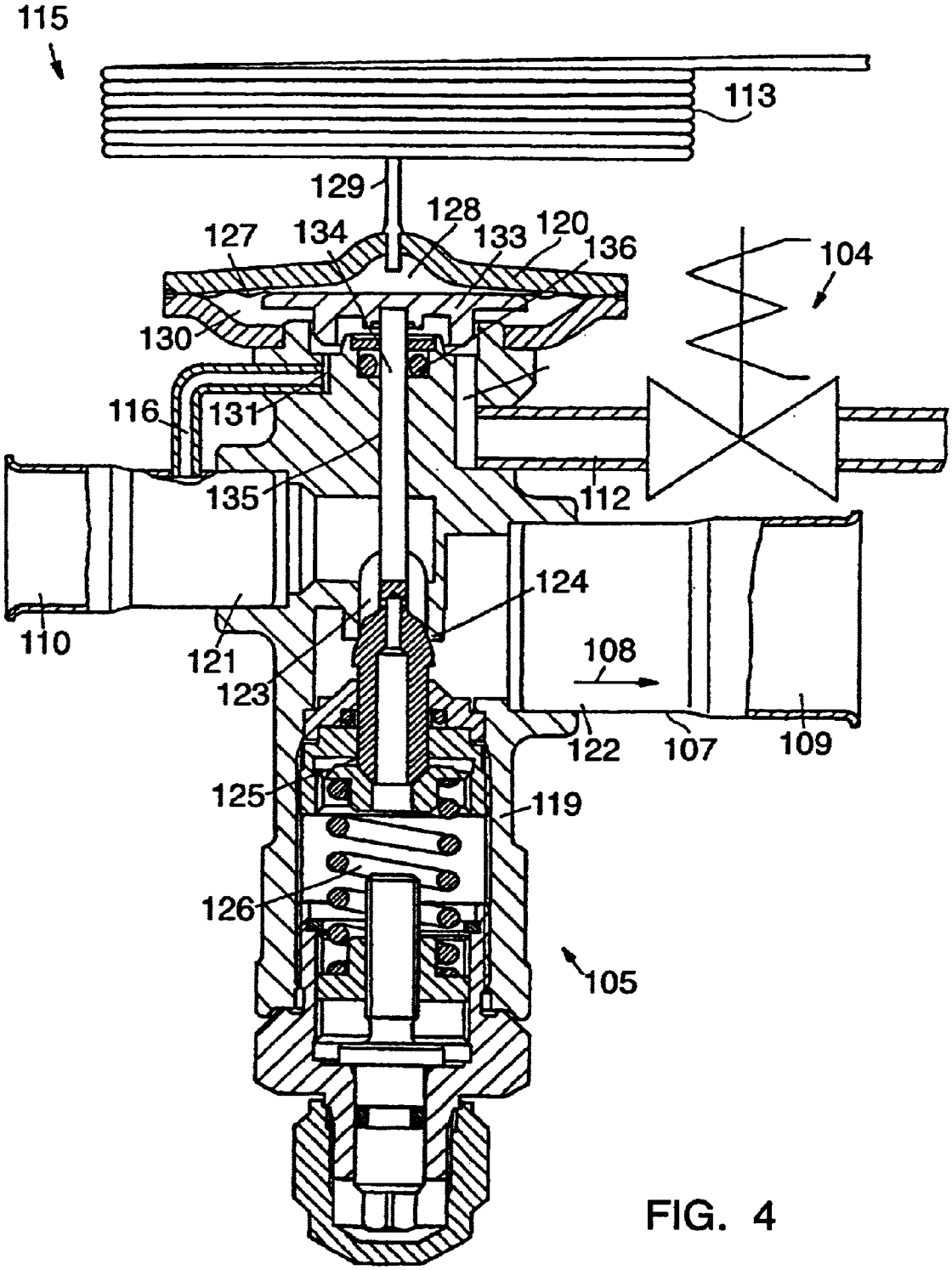
FIG. 4 is a cross-sectional side view through a valve arrangement according to FIG. 2

FIG. 4 shows a cross-section through a valve arrangement 115 according to the invention in accordance with FIG. 2. It has an expansion valve 105, comprising a valve housing 119, a diaphragm capsule 120, an inlet 121 on the high-pressure side 110 and an outlet 122 on the low-pressure side 109. The inlet 121 and the outlet 122 are connected with each other via a connection channel 123. In this connection channel 123 a valve seat 124 is formed, which cooperates with a valve element 125. The valve element 125 is biased in the direction of the valve seat 124 by means of a spring 126.

The diaphragm capsule 120 is fixedly connected with the valve housing 119 of the expansion valve 105. The inside of the diaphragm capsule is divided by a diaphragm 127. Over the diaphragm 127 a thermal pressure chamber 128 is formed, in which a capillary tube 129 ends, which is connected with the bulb 114. Under the diaphragm 127, the diaphragm capsule 120 has a working pressure chamber 130. In the following, the terms "over" and "under" merely refer to the views in FIGS. 4 to 7. Of course, also any other orientation of the valve arrangement 115 is possible.

The pressure in the thermal pressure chamber 128 depends on the temperature at the location of the bulb 114. The high-pressure control line 116 from the high-pressure side 110 as well as the pressure-equalizing connection 112 from the low-pressure side 109 of the working line 107 open into the working pressure chamber 130, under the diaphragm 127. In this way, the high-pressure control line 116, the working pressure chamber 130 and the pressure-equalizing connection 112 form a connection path that is part of the control line system 111. Both the high-pressure control line 116 and the pressure-equalizing connection 112 are substantially arranged outside the valve housing 119. Inside the valve housing 119, the high-pressure control line 116 has a restriction 131 and the pressure-equalizing connection 112 has a bore 132. Further, the closing element 104, in the form of a solenoid valve (schematic view), is arranged in the pressure-equalizing connection 112.

At the bottom side of the diaphragm 127 is arranged a diaphragm plate 133, which is connected with a pressure pin 134. The pressure pin 134 is guided in a pin bore 135 of the valve housing 119 and connects the diaphragm plate 133 via the connection channel 123 with the valve element 125. Under the diaphragm plate 133, a seal 136 comprising several seal parts is provided in the valve housing 119, the seal 136 seals the working pressure chamber 130 from the connection channel 123.

In the open state of the solenoid valve 104, the valve arrangement 115 works like a traditional arrangement. The working pressure chamber 130 is connected with the high-pressure side 110 via the high-pressure control line 116 and with the low-pressure side 109 of the working line 107 via the pressure-equalizing connection 112. As the restriction 131 of the high-pressure control line 116 has a substantially smaller cross-section than the bore 132 of the pressure-equalizing connection 112, the pressure from the high-pressure side 110 in the working pressure chamber 130 is removed again via the pressure-equalizing connection 112. The pressure in the working pressure chamber 130 is thus substantially determined by the pressure of the low-pressure side 109, which is typically approximately 5 bars.

A relation of 1:20 between a minimum cross-section of the high-pressure control line 116 to the minimum cross-section of the pressure-equalizing connection 112 has proved to be favorable. In this case, the forces, which act upon the diaphragm 127 from the spring 126 and the pressure in the working pressure chamber 130, are approximately as large as the force, which acts upon the diaphragm 127 from the pressure in the thermal pressure chamber 128. Via these generally oppositely directed forces acting upon the diaphragm 127, the position of the valve element 125 in relation to the valve seat 124, and thus the opening and closing of the connection channel 123 in the expansion valve 105, is determined. The forces occurring in the connection channel 123 because of the flow of the refrigerant are thus substantially balanced.

When the solenoid valve 104 is closed, the pressure from the high-pressure side 110 is built up in front of the solenoid valve 104 via the high-pressure control line 116, the working pressure chamber 130 and the beginning of the pressure-equalizing connection 112 and acts backward upon the working pressure chamber 130. Typically, this causes the pressure in the working chamber 130 to increase to approximately 15 bars, however, the invention is not limited in this regard. This causes the diaphragm 127 to be pressed upwards, which again causes the valve element 125 to be pressed against the valve seat 124 via the diaphragm plate 133 and the pressure pin 134. In this way, the closing of the solenoid valve 104 also causes the expansion valve 105 to close.

Figure 5:
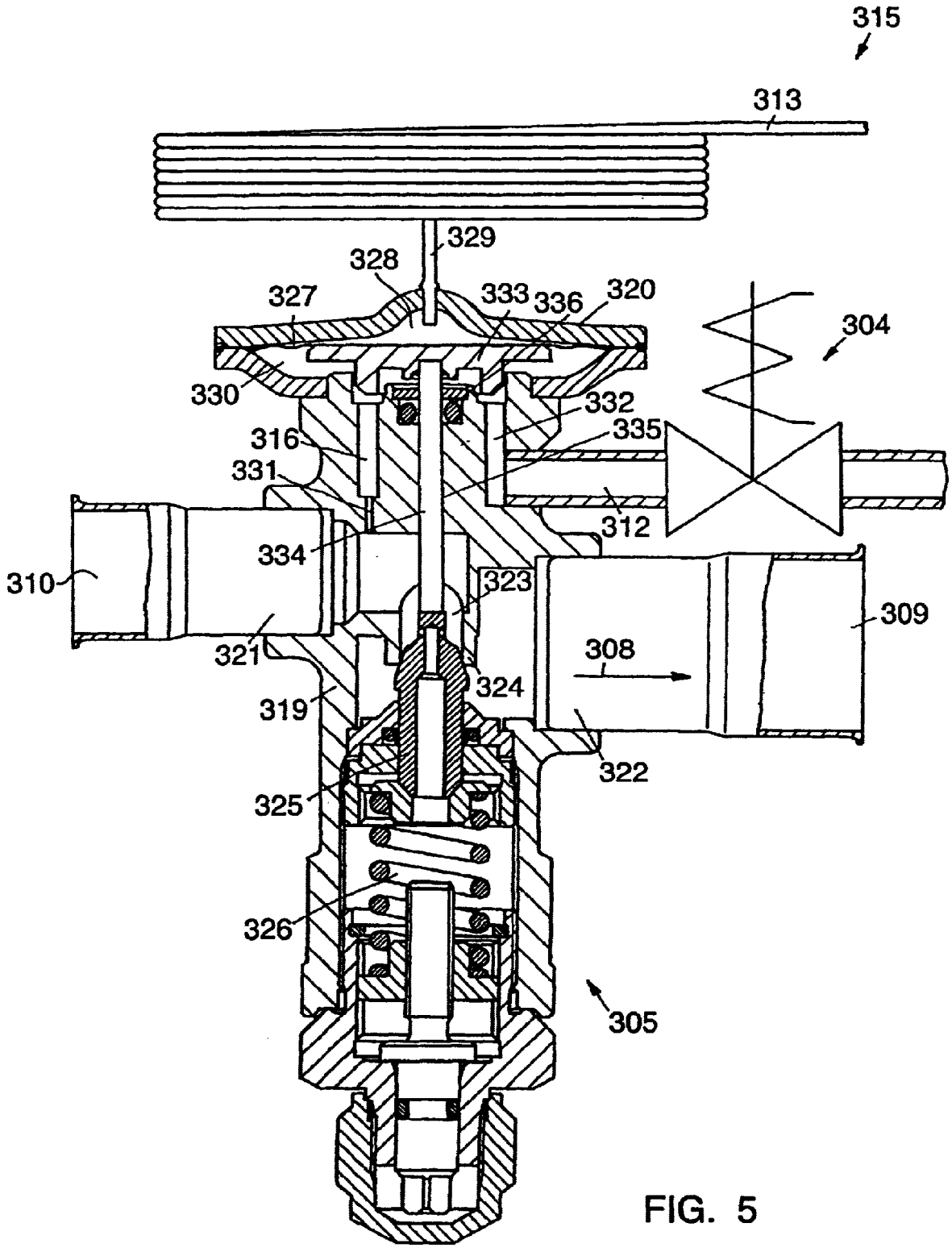
FIG. 5 is a cross-sectional side view through a further embodiment of the expansion valve arrangement according to FIG. 2 with an integrated high-pressure control line

FIG. 5 shows an alternative embodiment of the valve arrangement according to FIG. 4 in which the complete high-pressure line 316 is formed inside the valve housing 319. Also this high-pressure control line 16 has the restriction 331, which is now formed direct at the inlet 321 of the expansion valve 305.

Figure 6:
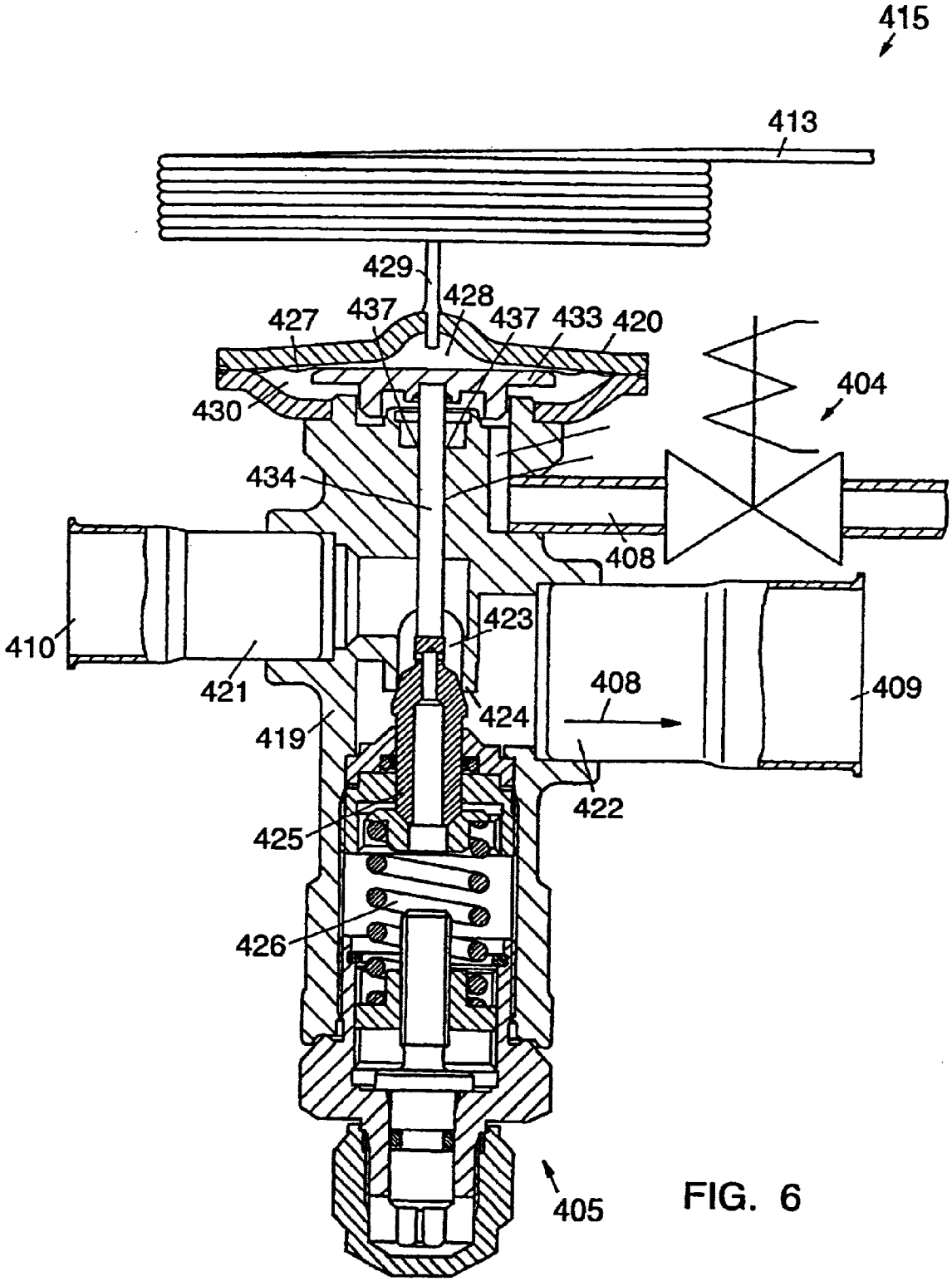
FIG. 6 is a cross-sectional side view through a further embodiment of the expansion valve arrangement according to FIG. 2 without a separate high-pressure control line

A further alternative embodiment of the valve arrangement 415 is shown in FIG. 6. It shows a traditional expansion valve 405, which has no specifically designed signal line from the high-pressure side 410 to the working chamber 430. The function of the high-pressure control line 116,316 according to FIGS. 4 and 5 is taken over by a leakage path 437, which is formed between the bore 435 and the pressure pin 434. In order that the pressure from the high-pressure side 410 can be passed on to the working pressure chamber 430 via the inlet 421 and the leakage path 437, the seal 136,336 under the diaphragm plate 133,333 must be removed.

Figure 7:
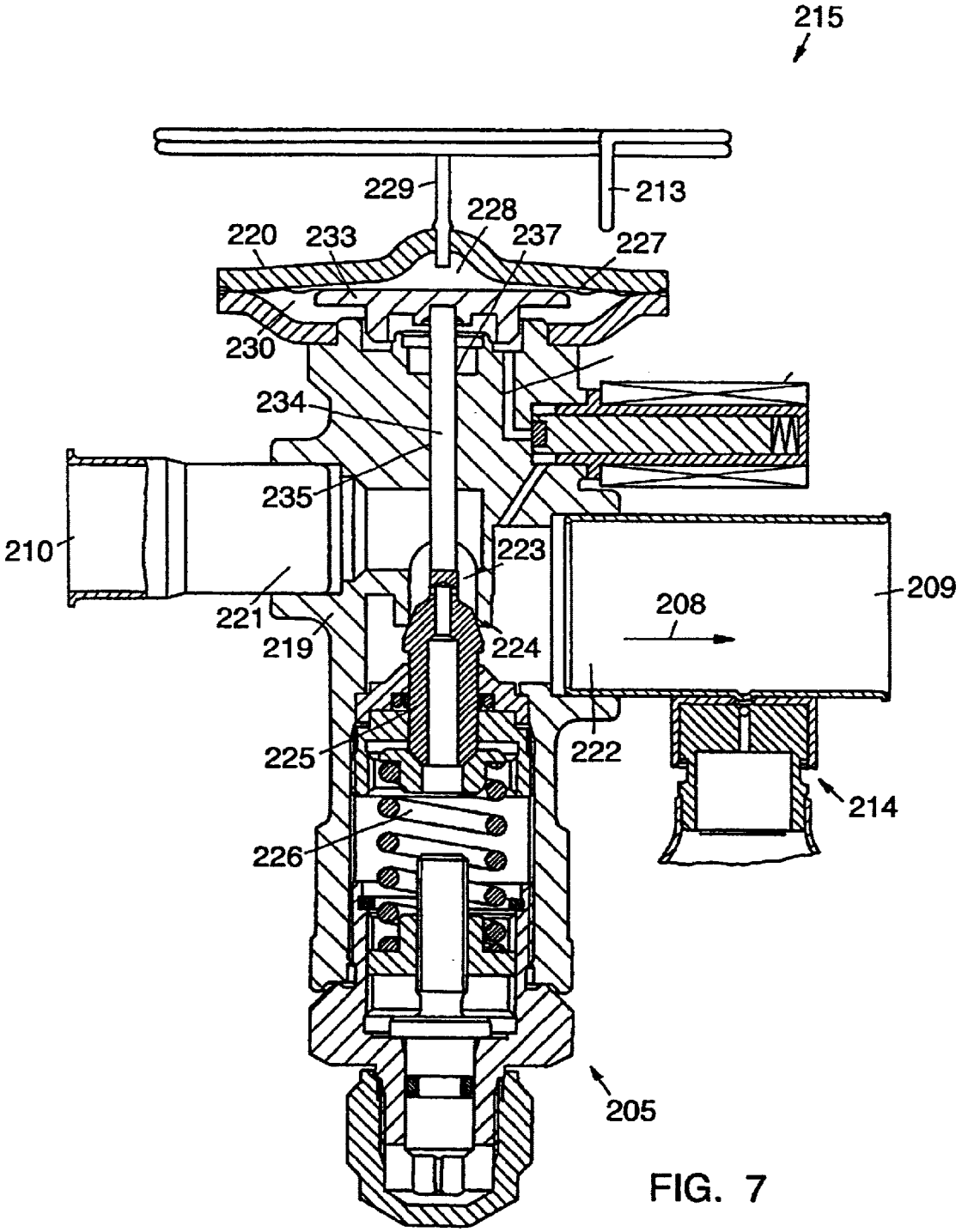
FIG. 7 is a cross-sectional side view through a valve arrangement according to FIG. 3.

FIG. 7 shows an additional embodiment of the valve arrangement in accordance with the refrigeration system shown schematically in FIG. 3. It shows an expansion valve 205, in which the pressure-equalizing connection 212 is made inside the valve housing 219. The pressure-equalizing connection 212 connects the working pressure chamber 230 via the closing element 204 with the outlet 222 of the expansion valve. The closing element 204 is also made directly on the valve housing 219. In this way, the expansion valve 205 and the closing element 204 can be optimally matched to each other during manufacture. Also in this embodiment, the function of the high-pressure control line 116,316 is taken over by the leakage path 237. As shown already in FIG. 3, the bulb 214 of this valve arrangement 215 is arranged immediately next to the outlet 222 of the expansion valve 205. The bulb 214 is provided with a heating element, with which the bulb temperature can be controlled.

It is also possible to combine the embodiments of the individual elements of FIGS. 4 to 7 in any other possible way. Further, the diaphragm 127–427 in the expansion valve 105–405 can be replaced by a bellows or any other suited and known deformation element.

Additionally, the solenoid valve 104,404 can be replaced by any other known and suited valve type, by means of which a sufficiently tight closing of the connection path can be achieved.

Additionally to the refrigeration systems 101,201 shown schematically in FIGS. 2 and 3, the valve arrangement 115,215 can also be used in any other suited refrigeration system 1. For example, such a use would also be appropriate in a system, in which a manual stop valve is normally arranged in series with a solenoid valve 4 and an expansion valve 5 in the working line 7. When such a system leaves the factory, refrigerant is often trapped in the working line 7 between the manual stop valve and the solenoid valve 4. During transport, the pressure in this section of the working line 7 between the two valves can become so high, that the working line is damaged. To avoid this, the solenoid valve 4 is usually equipped with a check valve, which opens in the direction of the expansion valve at a pressure of, for example, 25 bars. When using one of the valve arrangements 115,415 described above, in accordance with the FIGS. 2 to 7, however, such a check valve can be avoided. In such an arrangement, the damaging pressure between the manual stop valve and the expansion valve cannot occur, as the expansion valve 105–405 is not completely tight.

What is claimed is:

1. A valve arrangement for closing off a working line in a refrigeration system, comprising:

a working line having a high pressure section and a low pressure section;

an expansion valve coupled to the working line and including a diaphragm capsule having a diaphragm located therein and defining a working pressure chamber adjacent the diaphragm;

the expansion valve having a pressure equalizing connection extending between and in fluid communication with the working pressure chamber and the low pressure section of the working line;

a control line system including, the pressure equalizing connection and a control device having a closure element arranged in the pressure equalizing connection, the control line system connecting the high and low pressure sections of the working line, and wherein the control line system is configured to provide a closing pressure in the expansion valve by means of the control device.

2. A valve arrangement for closing off a working line in a refrigeration system as defined by claim 1 further comprising:

a high pressure control line coupled to and extending between the working pressure chamber and the high pressure section of the working line; and wherein a smallest cross-section defined by the pressure equalizing connection is larger than a smallest cross-section defined by the high-pressure control line.

3. A valve arrangement as defined by claim 2, wherein a ratio of the smallest cross-section of the high-pressure control line and the smallest cross-section of the pressure-equalising line is approximately 1:20.

4. A valve arrangement as defined by claim 1 wherein:

the expansion valve includes a valve housing; and the pressure equalizing connection defines area upon which the closure element acts, this area being outside of the valve housing.

5. A valve arrangement as defined by claim 4, wherein the area of the pressure-equalising connection, upon which the closing element acts, is arranged inside the valve housing of the expansion valve.

6. A valve arrangement as defined by claim 4, wherein the closure element is located on the valve housing of the expansion valve.

7. A valve arrangement as defined by claim 4, wherein the high-pressure control line is arranged outside the valve housing of the expansion valve.

8. A valve arrangement as defined by claim 4, wherein the high-pressure control line is arranged inside the valve housing of the expansion valve.

9. A valve arrangement as defined by claim 8, wherein the high-pressure control line is formed by a predetermined leakage path in the expansion valve.

10. A valve arrangement as defined by claim 1, wherein the connection path extends through the closure element and is hermetically sealable.

11. A valve arrangement as defined by claim 1, wherein the closure element is in the form of a solenoid valve.

* * * * *